United States Patent [19]

Wilde

[11] 4,391,902

[45] Jul. 5, 1983

[54] PHOTOGRAPHIC FILM WITH VARIABLE WINDOWS

[76] Inventor: Robert F. Wilde, 2023 Sheffield, Chicago, Ill. 60614

[21] Appl. No.: 310,882

[22] Filed: Oct. 13, 1981

[51] Int. Cl.[3] ..... G03C 3/02

[52] U.S. Cl. ..... 430/501; 352/241; 354/210

[58] Field of Search ..... 430/501, 500; 352/97, 352/183, 204–207, 241

[56] References Cited

U.S. PATENT DOCUMENTS

| | | | |
|---|---|---|---|
| 763,024 | 6/1904 | Schmid | 430/501 |
| 780,283 | 1/1905 | Hahn | 430/501 |
| 1,312,052 | 7/1919 | Sartorius et al. | 430/501 |
| 1,467,543 | 9/1923 | Hansen | 430/501 |
| 1,588,869 | 6/1926 | Wolk | 430/501 |
| 2,081,264 | 5/1937 | Brenn | 352/97 |

FOREIGN PATENT DOCUMENTS

| | | | |
|---|---|---|---|
| 229620 | 2/1944 | Switzerland | 354/210 |

*Primary Examiner*—J. Travis Brown

*Attorney, Agent, or Firm*—Tilton, Fallon, Lungmus & Chestnut

[57] ABSTRACT

A photographic film including at least two elongated film strips of photosensitive material each divided into a sequence of longitudinally spaced frames and arranged in face-to-face superposed relation with the frames of the strips being longitudinally aligned, one of the film strips having certain of the frames free of photosensitive material whereby light from an image to be photographed is adapted to pass therethrough for registry on the adjacent strip with the strips being reeled on a single reel.

6 Claims, 5 Drawing Figures

PHOTOGRAPHIC FILM WITH VARIABLE WINDOWS

BACKGROUND OF THE INVENTION

This invention relates to photographic film with variable windows and, more particularly, to film having increased variability and variety for the taking of photographs. The photographic film makes use of two elongated strips each equipped with photosensitive material for this purpose.

Superposed strips for photographic purposes have long been known—but for different purposes. For example, the difficulty in obtaining focus resulted in the use of transparent portions in film strips as seen in U.S. Pat. No. 1,312,052 of 1919, Austrian Pat. No. 87916 of 1921 and U.S. Pat. No. 1,467,543 of 1923. None of these, however, teach the idea of a photographer using more than one film medium on any one spool of film.

The instant invention addresses the problem that each roll of film used in a camera has only one ASA reading or sensivity speed for light reception. The automatic cameras are set at this ASA reading and the entire roll of film is exposed at this standard. This is determined largely by the limitations of darkroom processing.

In addition to this, the receptive chemicals for each type of developing process must be the same for the entire roll. For instance, color receptive chemicals on one roll, black and white receptive chemicals on another. If the cameraman wants to change his mode of photographing, he must either change cameras or change the roll of photographic film.

SUMMARY OF INVENTION

The object of this invention is to provide a roll of film whereby the photographer can use more than one film medium on any one spool of film. Thus, black and white, and color pictures, can be obtained from the same roll or cartridge of film without changing cameras or changing the roll of film. In accordance with the invention, light sensitive, unexposed negative film strip is provided. In this elongated strip of photosensitive material, equidistant areas related to the shutter size of the camera are found, generally referred to as frames. Certain of the frames in one of adjadent strips are transparent, as by being delimited by cutouts so that the light from an image can pass there through onto the rearward strip for actuating the photosensitive material.

The invention is described in conjunction with the accompanying drawing, in which.

DETAILED DESCRIPTION

Figure 1:
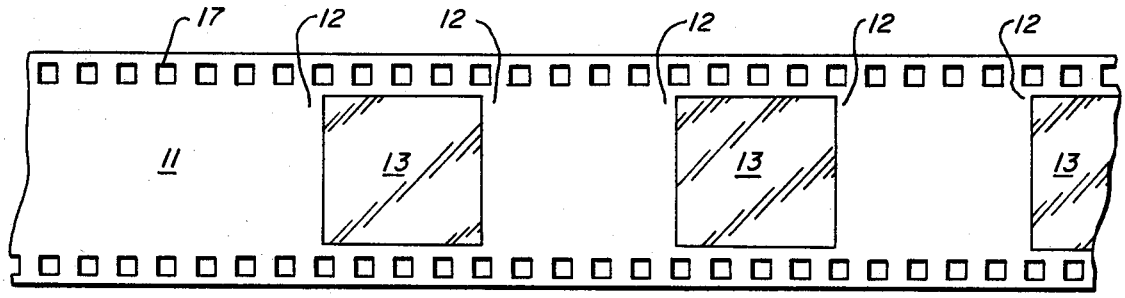
FIG. 1 is an elevational view of a film strip with alternate frames cut out so as to form windows.
Figure 2:
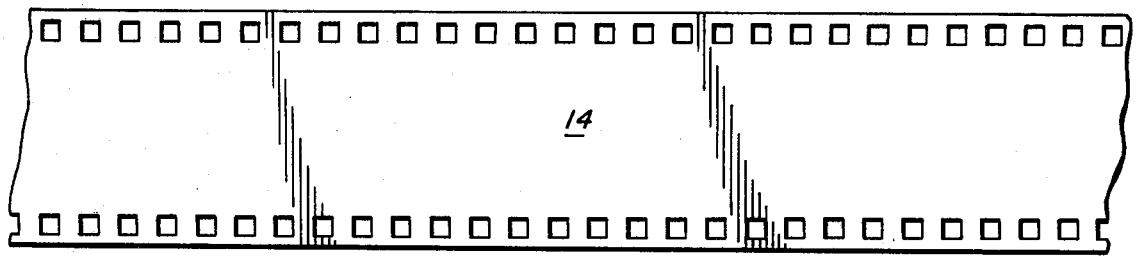
FIG. 2 is an elevational view of another film strip of continuous nature which is arranged to be in face-to-face, superposed relation to the film strip of FIG. 1.
Figure 3:
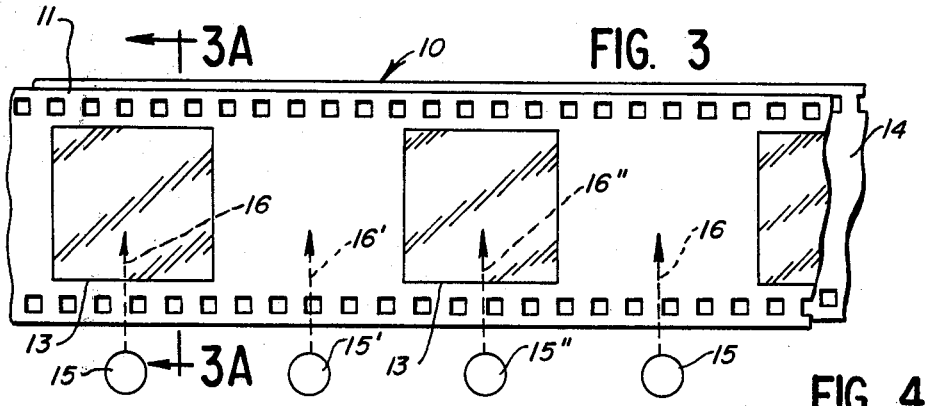
FIG. 3 is a slightly exploded view of the assembly of the film strips of FIGS. 1 and 2.
Figure 3A:
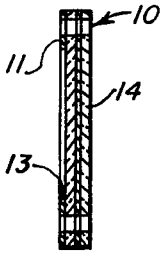
FIG. 3A is a sectional view taken along the sight line 3A—3A of FIG. 3.

In the illustration given and with reference first to FIGS. 3 and 3A, the inventive film strip assembly is generally designated by the numeral 10. This is seen to consist of a first film strip 11 (see FIG. 1) which is equipped with a series of frames 12 determined by the shutter size of the camera. The camera may be snapshot or movie and the film provided in a reel, cartridge, etc. A series of cut out spaces 13 are provided in alternate frames—as illustrated—which constitute windows permitting light to pass through to the rearward continuous film strip 14 (see FIG. 2).

In FIG. 3, a light source area 16 from lens 15 strikes and exposes film strip 14. The camera then advances the film one frame and light source arrow 16' from lens 15' strikes and exposes film strip 11. After the next advancement, light source 16" from lens 15" strikes and exposes film strip 14 after passing through window 13. This process continues through the entire roll of film. Odd number frames expose film strip 14, even numbered frames film strip 11.

During the manufacturing process, either one or the other or both flim strips may have alternate frames "stamped out" along with the side perforations 117 (see FIG. 1) which are already in place. When the film is to be developed, the two negatives are separated and processed separately according to the conditions indicated for the photographic material contained thereon.

Figure 4:
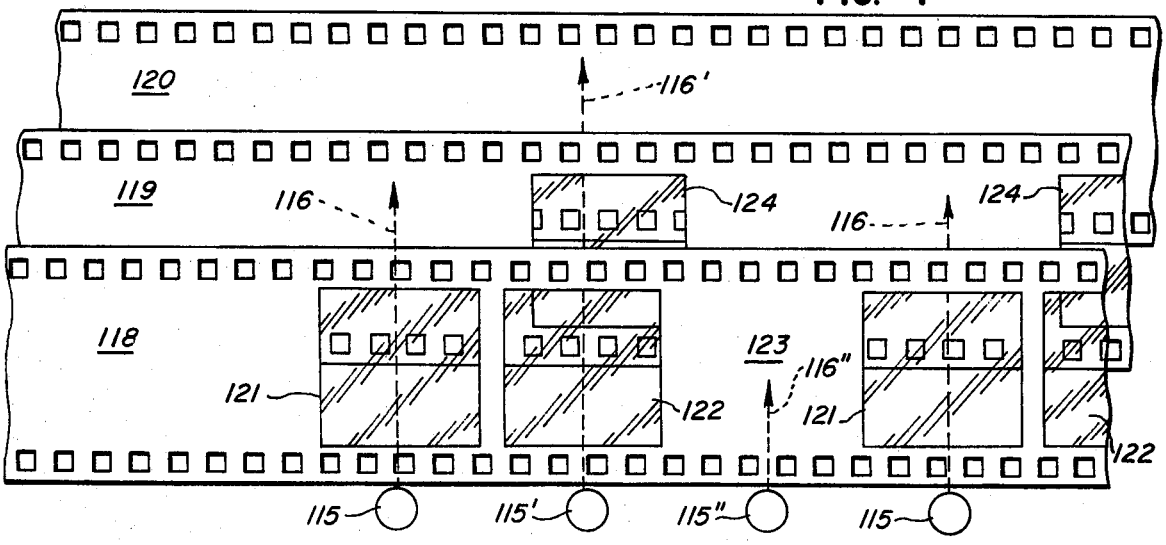
FIG. 4 is an exploded view of a three-strip assembly, constituting a variation of FIG. 3.

In FIG. 4, three different film strips are used. These are, respectively, in proceeding from front to back, i.e., proceeding away from the lens 115 and are designated 118, 119, and 120, respectively. Film strip 118 has a window 121 in one frame and another window 122 in an adjacent frame. The third frame is windowless as at 123. The sequence then is duplicated. In other words, there is a sequence of two windows or transparent portions followed by a third portion which is opaque and photosensitive. In the second film strip 119, there is a sequence of single windows as at 124 which are aligned only with the windows 122 of film strip 118. The third film strip 120 is unapertured.

In operation, imaging light 116 from the lens 115 passes through the window 121 to impinge upon a frame of the strip 119. As the film is advanced, another sequence is represented by imaging light 116' emanating from the lens 115' which passes through the window 122 and the film strip 118, then through the window 124 of the film strip 119 to impinge upon the film strip 120. Concluding the one cycle like 116" from the lens 115' impinges upon the frame 123 of the film strip 118.

While in the foregoing specification, details of the invention have been set down for the purpose of illustration, many variations in the details hereingiven may be made by those skilled in the art without departing from the spirit and scope of the invention.

I claim:

1. A film product comprising at least two elongated film strips of photosensitive material each divided into a sequence of longitudinally spaced frames and arranged in face-to-face, superposed relation with the frames of the strips being longitudinally aligned, one of said film strips having certain of the frames thereof free of said photosensitive material whereby light from an image to be photographed is adapted to pass therethrough for registry on the next adjacent superposed strip, said strips being wound on a single spool.

2. The product of claim 1 in which one of said strips is equipped with photosensitive material adapted to register an image in black and white while another of said strips is equipped with photosensitive material adapted to register an image in color.

3. The product of claim 1 in which said one strip has frame portions removed to permit said light passage.

4. The product of claim 3 in which said one strip is equipped with photosensitive material adapted to register an image in black and white, a second strip being positioned therebehind in the path of light travel and equipped with photosensitive material adapted to register an image in color.

5. The product of claim 1 in which said certain frames are arranged in adjacent pairs, a next adjacent film being equipped with frames adapted to pass light through only one of said certain frames, and a third strip equipped with photosensitive material adapted to register an image from light passing through said one and next adjacent strips.

6. A film product comprising at least two elongated film strips of photosensitive material each divided into a sequence of longitudinally spaced frames and arranged in face-to-face, superposed relation with the frames of the strips being longitudinally aligned, one of said film strips having certain of the frames thereof free of said photosensitive material whereby light from an image to be photographed is adapted to pass therethrough for registry on the next adjacent superposed strip, said product being equipped with index openings along the longitudinal sides thereof for film movement in a camera, said product being reeled on a single reel so as to position said one strip first in the path of light from an image to be photographed.

* * * * *